US006211768B1

(12) United States Patent
Cress et al.

(10) Patent No.: US 6,211,768 B1
(45) Date of Patent: Apr. 3, 2001

(54) NON-VENTING CUTOUT MOUNTED FUSE

(75) Inventors: Stephen L. Cress, Kettleby; Robert J. Tout, Brampton, both of (CA)

(73) Assignee: Ontario Power Generation Inc., Toronto (CA)

( * ) Notice: Subject to any disclaimer, the term of this patent is extended or adjusted under 35 U.S.C. 154(b) by 0 days.

(21) Appl. No.: 09/376,337

(22) Filed: Aug. 18, 1999

(51) Int. Cl.[7] ..... H01H 85/055; H01H 85/04

(52) U.S. Cl. ..... 337/292; 337/161; 337/162; 337/168; 337/169; 337/171; 361/104

(58) Field of Search ..... 337/292, 159, 337/161, 162, 163, 164, 168, 169, 171, 172, 173, 174, 175, 186, 228, 229, 248, 251, 290; 361/102, 115, 104

(56) References Cited

U.S. PATENT DOCUMENTS

| | | | | |
|---|---|---|---|---|
| 1,353,123 | * | 9/1920 | Kries | 337/229 |
| 2,066,129 | * | 12/1936 | Triplett | 337/162 |
| 2,496,704 | * | 2/1950 | Fahnoe | 337/161 |
| 2,667,551 | * | 1/1954 | Berthel | 337/166 |
| 2,787,684 | * | 4/1957 | Laing | 337/164 |
| 2,917,605 | * | 12/1959 | Fahnoe | 337/159 |
| 3,243,552 | * | 3/1966 | Mikulecky | 337/162 |
| 3,294,936 | * | 12/1966 | Mikulecky | 337/159 |
| 3,304,387 | * | 2/1967 | Lindell | 337/162 |
| 3,304,388 | * | 2/1967 | Lindell | 337/162 |
| 3,304,389 | * | 2/1967 | Lindell | 337/162 |
| 3,304,390 | * | 2/1967 | Lindell | 337/162 |
| 5,239,291 | * | 8/1993 | Henricks et al. | 337/164 |

* cited by examiner

*Primary Examiner*—Leo P. Picard
*Assistant Examiner*—Anatoly Vortman
(74) *Attorney, Agent, or Firm*—Ridout & Maybee

(57) ABSTRACT

A non-venting current limiting fuse for mounting in a cutout comprises a high current fuse component and a low current fuse component housed in separate compartments of a housing and connected in series. Interruption of a low current overload results in operation of the low current fuse component only, with the high current component being unaffected. The low current fuse component is removable from the housing such that when a low current overload situation exists, the low current fuse component can be simply removed and replaced without the need for replacement of the more costly high current fuse component.

11 Claims, 11 Drawing Sheets

TEST 3
16: 44: 29 12/05/94
I
VOLTS
100
0
-100
0.0000
-0.03
-0.02
-0.01
0.00
0.01
SECONDS

VARC
VOLTS
2000
00
-2000
0.0000
-0.03
-0.02
-0.01
0.00
0.01
SECONDS

TEST 3
16: 46: 23 12/05/94
I
VOLTS
100
0
-100
0.0000
-0.03
-0.02
-0.01
0.00
0.01
SECONDS

VARC
VOLTS
2E4
0E4
-2E4
0.0000
-0.03
-0.02
-0.01
0.00
0.01
SECONDS

TEST 4
16: 19: 28 12/06/94
I
VOLTS
40
20
0
-20
-40
0.0000
-0.04
-0.02
0.00
0.02
0.04
0.06
SECONDS

VARC
VOLTS
2E4
0E4
-2E4
0.0000
-0.04
-0.02
0.00
0.02
0.04
0.06
SECONDS

TEST 7
15: 46: 22 12/06/94
I
2000
VOLTS
00
-2000
-0.010
-0.005
0.000
0.0000
SECONDS

VARC
5E4
VOLTS
0E4
-5E4
-0.010
-0.005
0.000
0.0000
SECONDS

PREDICTED AND MEASURED TIME-CURRENT CHARACTERISTICS FOR THE NON-VENTING CUTOUT FUSE PROTOTYPE

NON-VENTING CUTOUT MOUNTED FUSE

FIELD OF THE INVENTION

The present invention relates to non-venting cutout-mounted current limiting fuses for use in protecting power distribution equipment such as overhead distribution transformers and capacitors.

BACKGROUND OF THE INVENTION

Several traditional methods exist to provide overcurrent protection for distribution equipment. Some of these methods include a distribution fuse cutout with an expulsion fuse link, a distribution cutout in combination with a back-up current limiting fuse (CLF), internal expulsion and current limiting fuses such as completely self protected transformers, and single general-purpose CLF's in a cutout. Each of these methods have their inherent advantages and disadvantages.

The expulsion fuse in a fuse cutout is inexpensive, but provides no energy limiting ability. There has been concern at many utilities about the hot particles and gases that are ejected when expulsion fuses operate. This is particularly dangerous when a lineman is on the pole and closes a cutout into a fault.

The use of two fuses in series allows the replacement of only the unit that has interrupted the overcurrent, thus saving the cost of replacing the intact fuse. The expulsion fuse in this combination is sized to blow on low currents. Only when the available fault current is high, does the more expensive back-up current-limiting fuse operate. The distribution cutout also provides a convenient means of disconnection for the transformer. The disadvantage of this two-fuse method is in the installation space required, and the necessity to stock and carry both of these types of fuses. Also, the venting problem is not entirely eliminated and there is no indication of the operation of the back-up CLF. Also, back-up CLF's are prone to eventful failure if they become damaged and operated on a current below their minimum interrupting rating.

Completely self-protected (CSP) transformers offer a version of the two-fuse method, with the CLF located inside the transformer tank. The internal CLF provides a more compact installation, but the CLF cannot be easily accessed. Some utilities using CSP overhead transformers, however, are unhappy with some aspects of these units. In particular, they would like to have the internal fuses, which are currently mounted inside the transformer tank, accessible for replacement. Also, some utilities find the internal molded case breakers are prone to nuisance blowing and do not allow the utility to emergency load their transformers. At the same time these utilities appreciate the compactness and ease of installation of the CSP units. CSP transformers are particularly desirable in voltage conversion applications when use of the original poles does not allow space for a cutout and back-up CLF to be mounted.

Where space is limited and the presence of an expulsion fuse is undesirable, a single cutout-mounted general-purpose fuse is sometimes preferred. The general-purpose CLF is more compact, but the entire expensive unit must be replaced whenever the fuse operates, even though it may have only been required to interrupt a low current that could have been interrupted by an inexpensive fuse link.

To date there has not been a single solution which address the needs for a compact, inexpensive cutout-mounted fuse which is non-venting and replaceable.

SUMMARY OF THE INVENTION

The present invention overcomes the above-discussed problems of the prior art by providing a non-venting cutout-mounted current limiting fuse having a high current fuse element and a low current fuse element connected in series and housed in separate compartments of a compact housing. Interruption of a low current overload results in operation of the low current fuse element only, with the high current element being unaffected. The low current fuse element is contained in a low current fuse component which is removable from the housing such that when a low current overload situation exists, the low current fuse component can be simply removed and replaced without the need for replacement of the more costly high current fuse element.

Furthermore, the low current fuse component is constructed in such a way that the problem of gas and particle emissions resulting from operation of the low current element is either reduced or eliminated. Specifically, the low current fuse element is contained within a separate housing and is separated from the walls thereof by an energy absorbing material such as sand.

Accordingly, in one aspect the present invention provides a current limiting fuse for mounting in a cutout, comprising: a first housing having first and second compartments; a first fuse element adapted to operate at a high current, the first fuse element contained within the first compartment; and a second fuse element adapted to operate at low current, the second fuse element contained within the second compartment, wherein the first and second fuse elements are electrically connected in series.

BRIEF DESCRIPTION OF THE DRAWINGS

Further features and advantages of the method and device embodying the present invention will now be described and made clearer from the ensuing description, reference being had to the accompanying drawings, in which.

DETAILED DESCRIPTION OF PREFERRED EMBODIMENTS

As a solution to the shortcomings of existing current limiting apparatus for overhead distribution equipment, the present invention, a non-venting cutout-mounted fuse (NVCF), has been developed. The NVCF is a single fuse unit of the same dimensions as the present general-purpose CLF, however, the NVCF allows inexpensive resetting of the fuse after low current operations.

Figure 1:
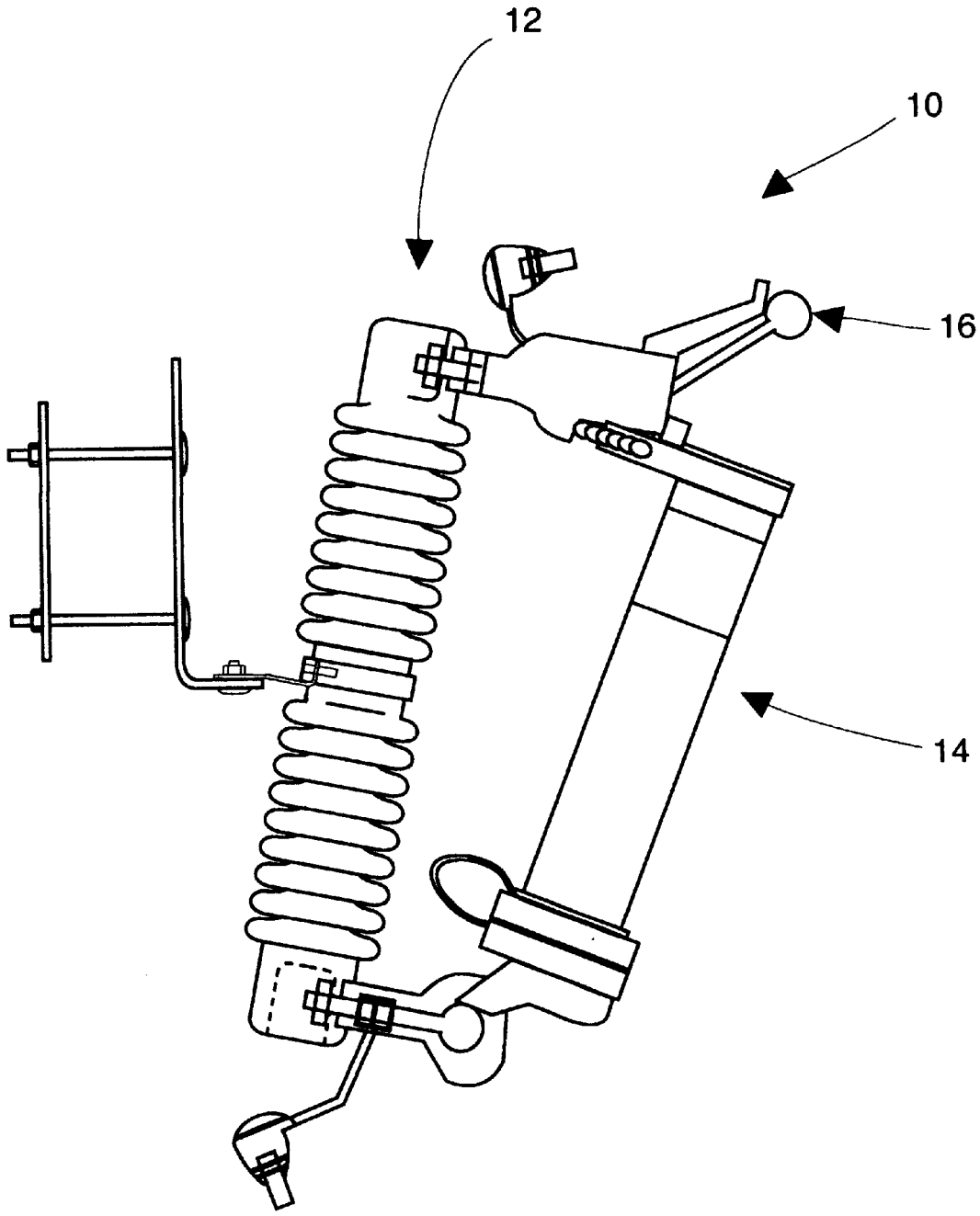
FIG. 1 is a side view of a non-venting cutout fuse according to a preferred embodiment of the present invention mounted in a conventional distribution cutout.
Figure 2:
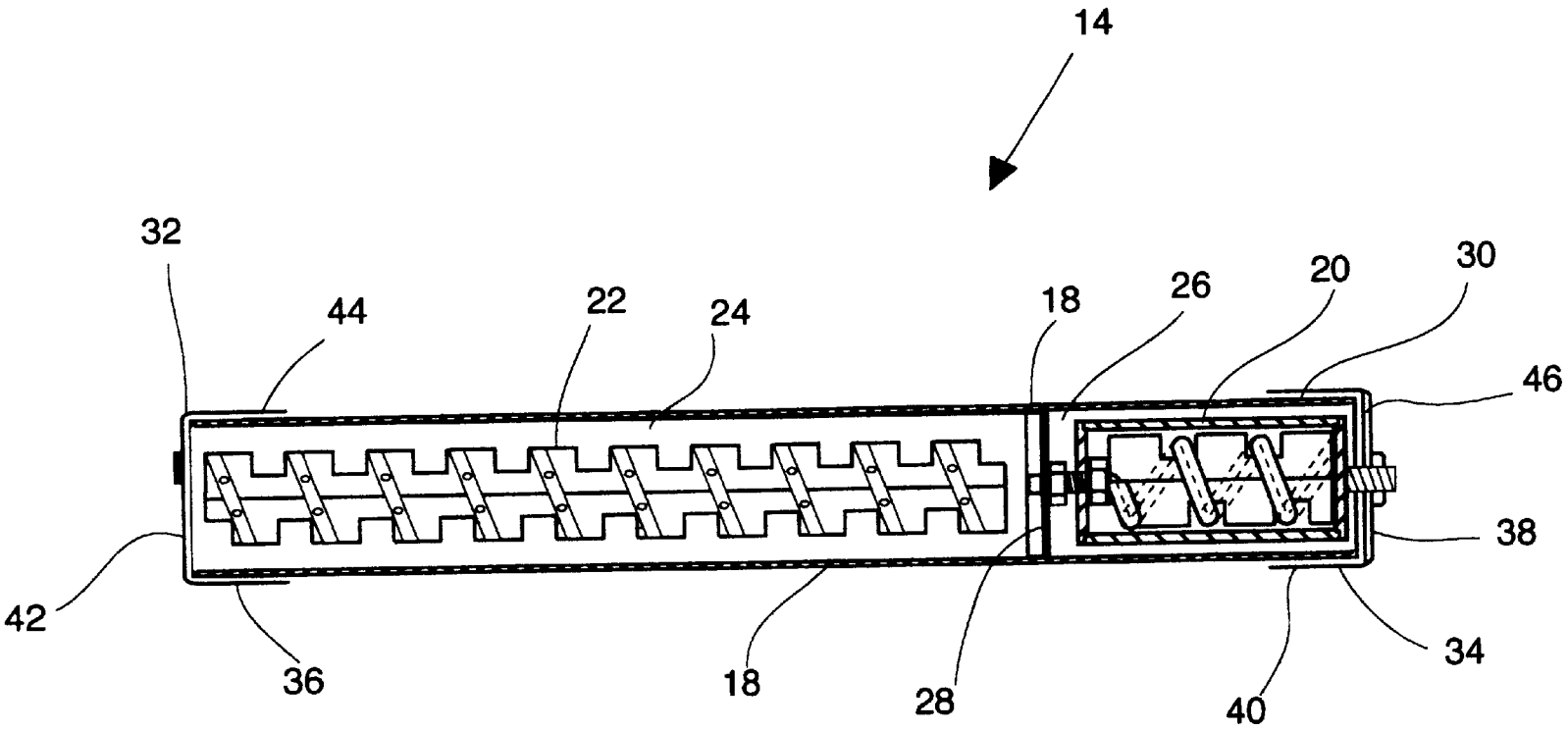
FIG. 2 is an isolated cross-sectional side view of the non-venting cutout mounted fuse shown in FIG. 1.

In FIG. 1, a preferred NVCF according to the invention mounted in a conventional distribution cutout is shown generally as item 10. The cutout and the NVCF are shown as items 12 and 14, respectively. A disconnecting handle 16 is shown as comprising part of the hardware required to mount the NVCF into the distribution cutout. Referring now to FIG. 2, fuse 14 is housed in a fiber-glass tube 18 similar to that used to house traditional full-range current limiting fuses. In contrast to the conventional CLF, however, external fiber-glass tube 18 houses two components: a replaceable low-current fuse component 20, and a high-current fuse component 22. In one preferred embodiment of a non-venting cutout fuse according to the invention, the fiber-glass tube 18 comprises a cylinder having a length of about 360 mm, an outside diameter of about 56 mm and an inside diameter of about 51 mm.

Tube 18 is divided into two separate compartments, a first compartment 24 configured to contain high current fuse component 22, and a second compartment 26, which is configured to contain replaceable low current fuse component 20. In preferred fuse 14 in which tube 18 has the above dimensions, the first compartment 24 preferably has a length of about 264 mm and the second compartment 26 preferably has a length of about 85 to 90 mm. Compartments 24 and 26 are separated by barrier 28 which is preferably comprised of a fiber-glass disc having a thickness of about 5 mm and being of a diameter to fit snugly inside tube 18.

The tube 18 is closed at its respective ends 30 and 32 by end caps 34 and 36, each of which comprise a flat end wall and a cylindrical side wall. Specifically, end cap 34 seals end 30 of second compartment 26 and comprises end wall 38 and side wall 40, while end cap 36 seals the end of the first compartment 24 and comprises end wall 42 and side wall 44. Where tube 18 has the above dimensions, the cylindrical side walls 40, 44 preferably each have a length of about 32 mm and a diameter of about 58 mm, to thereby allow caps 34 and 36 to fit over the ends of tube 18. The end caps 34 and 36 are preferably comprised of an electrically conductive material, with copper being preferred. End cap 36 is preferably sealed to end 32 of tube 18 by a hardened resin material, such as an epoxy resin. The inner surface of end wall 38 of cap 34 is preferably provided with a resilient sealing material such as a rubber seal 46 to seal the end of second compartment 26. The rubber seal 46 may preferably have a thickness of about 2 mm.

Figure 3:
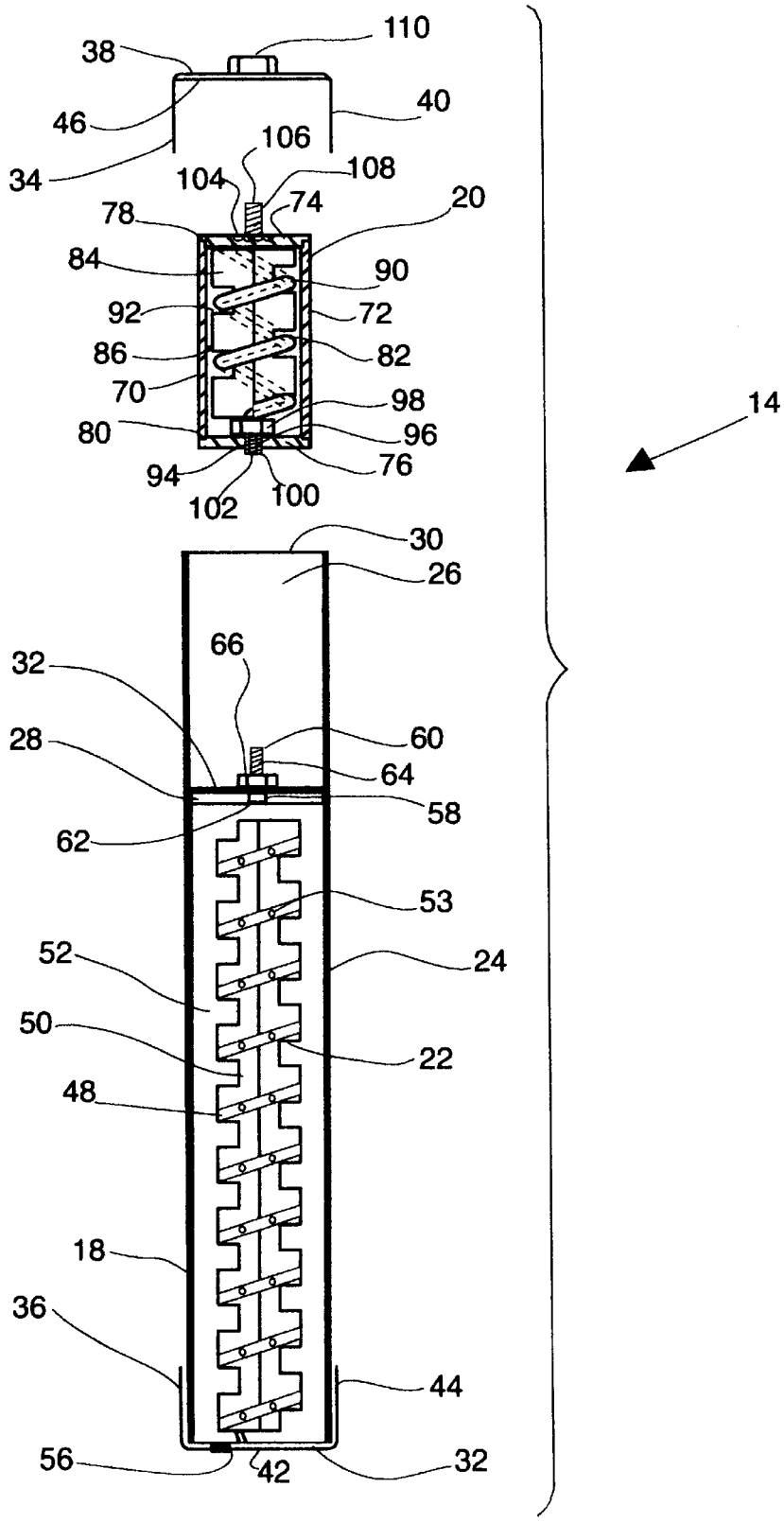
FIG. 3 is a cross-sectional side view of the fuse of FIG. 1 showing the low current fuse component removed.
Figure 4:
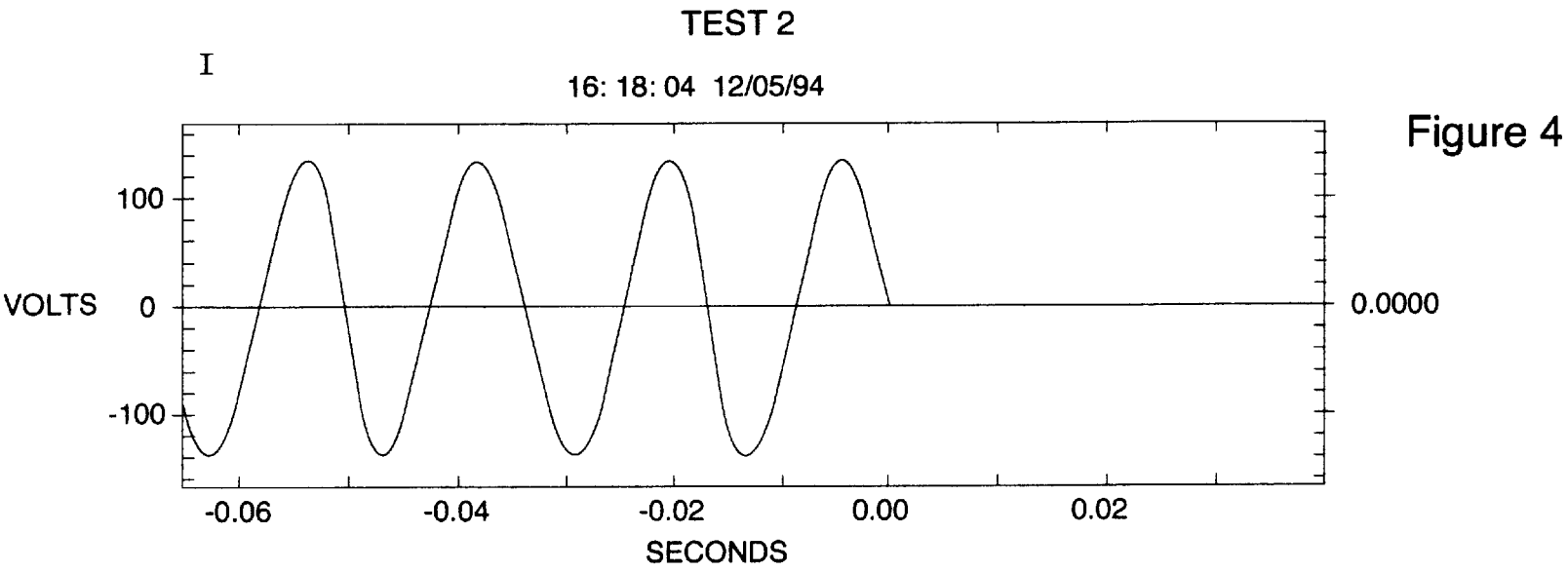
FIGS. 4 to 16 are current and voltage waveforms for non-venting cutout mounted fuses according to the present invention.
Figure 5:
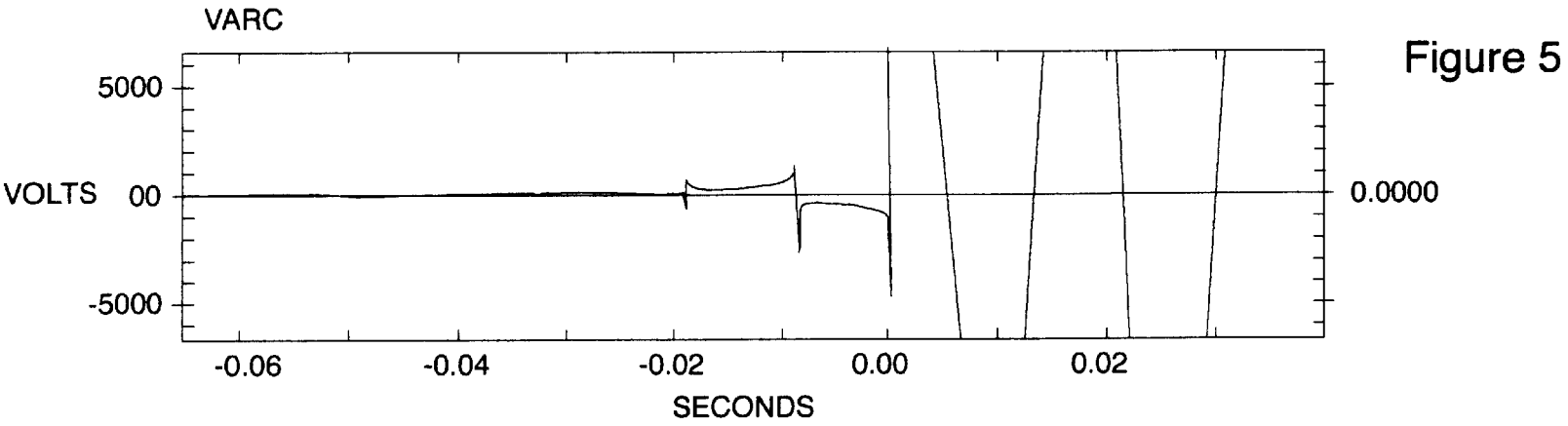
Figure 6:
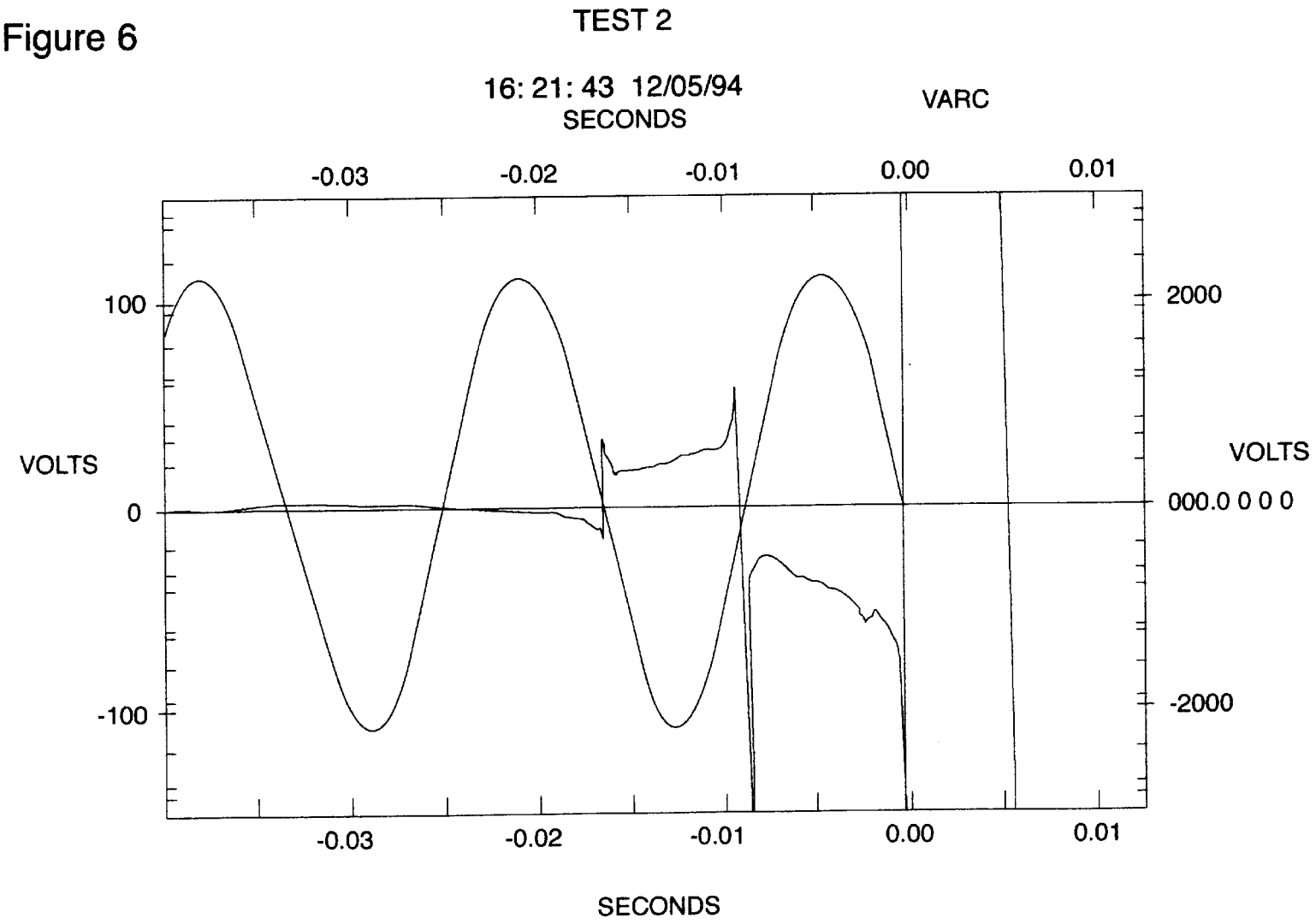
Figure 7:
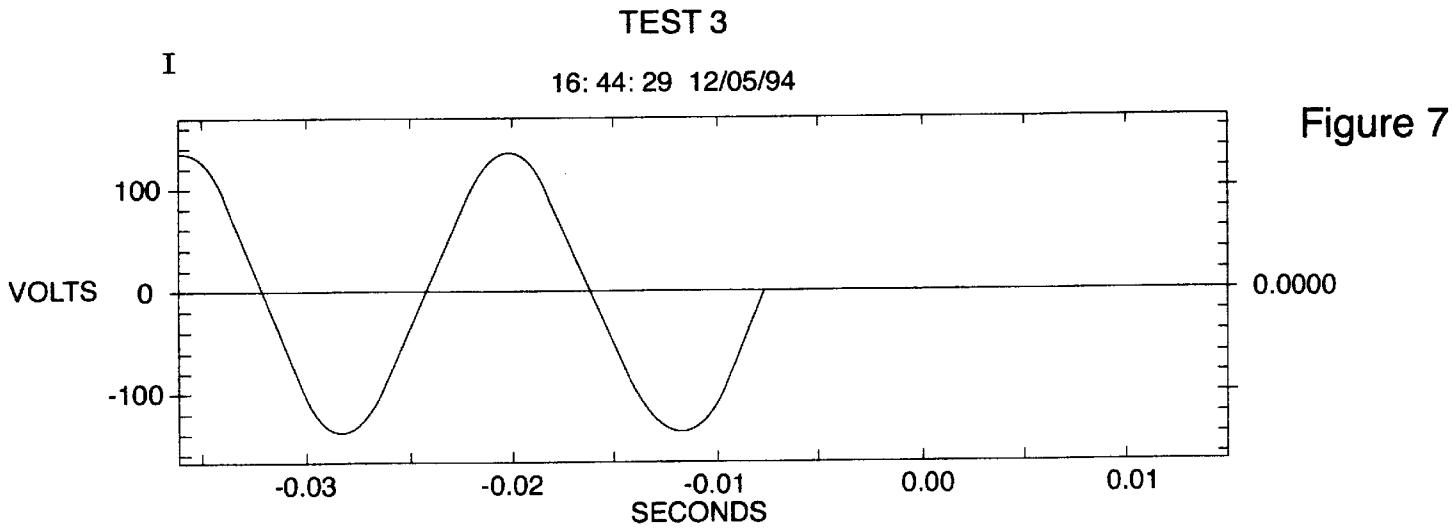
Figure 8:
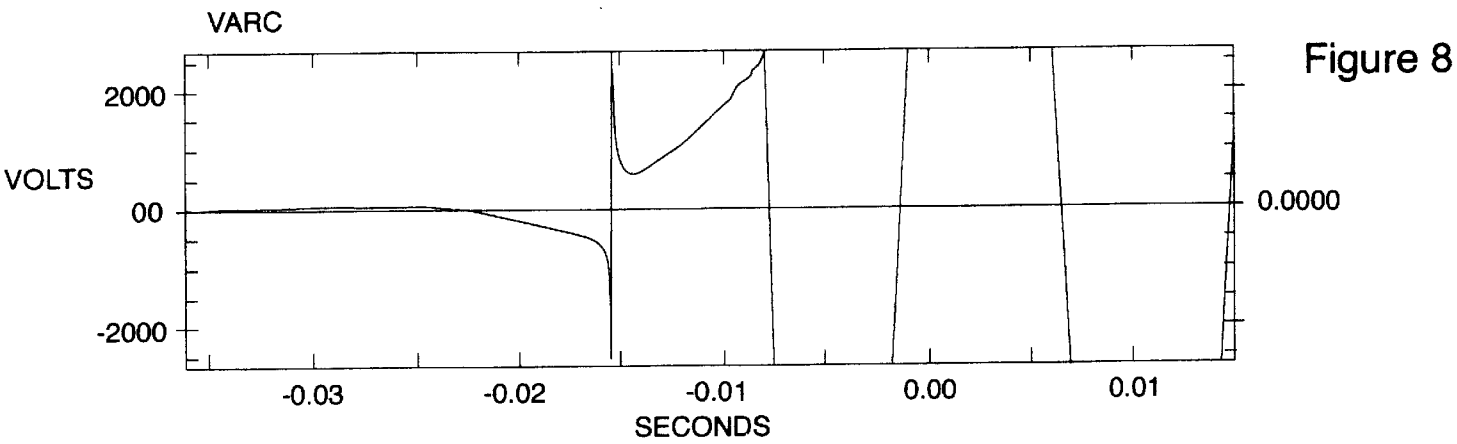
Figure 9:
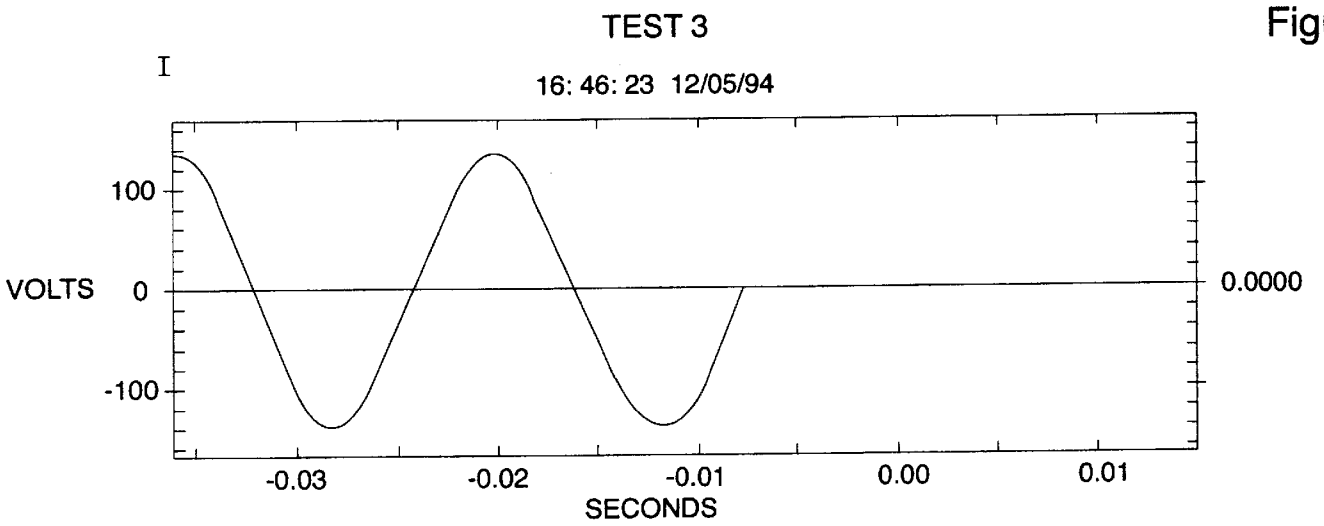
Figure 10:
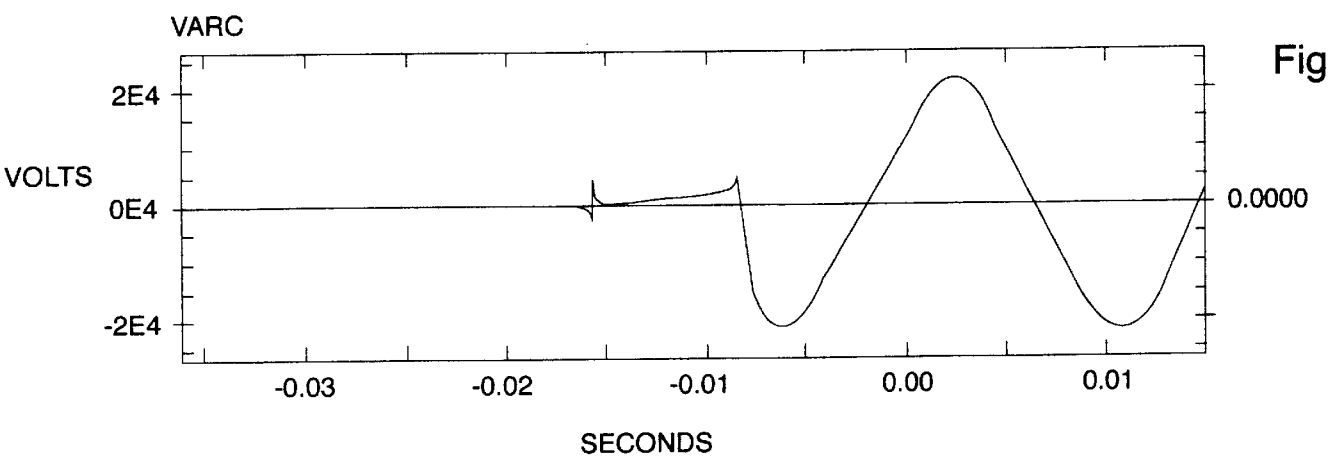
Figure 11:
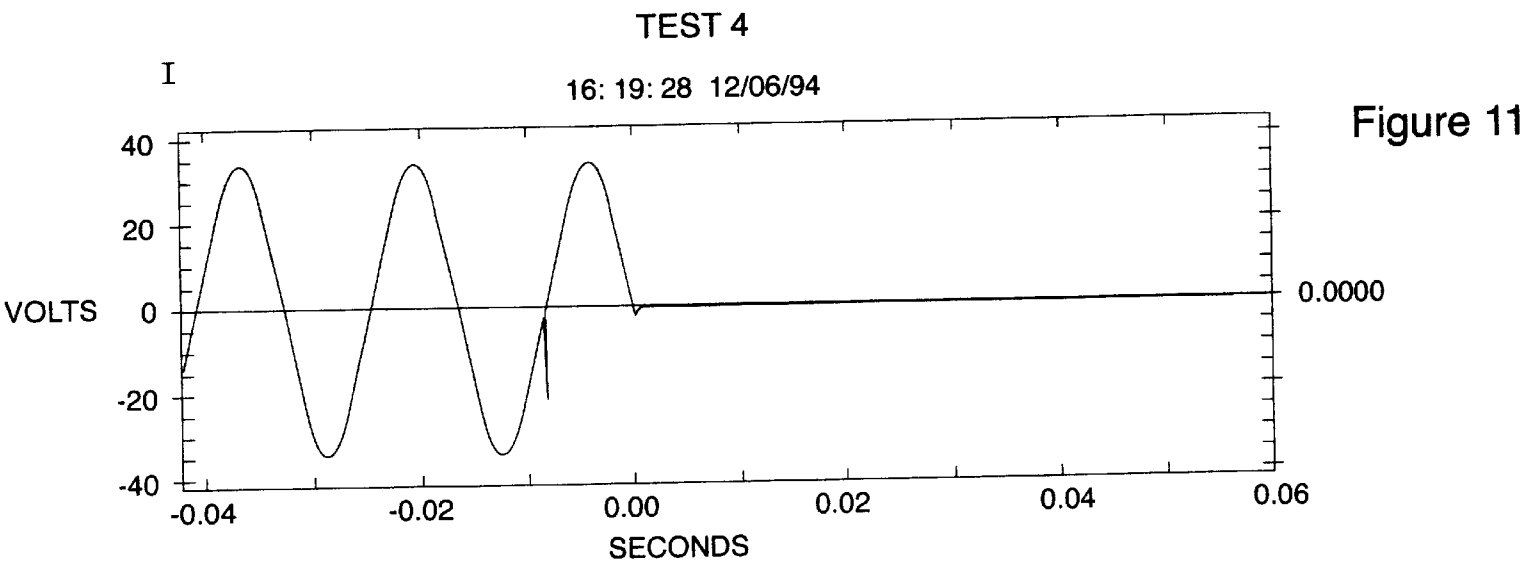
Figure 12:
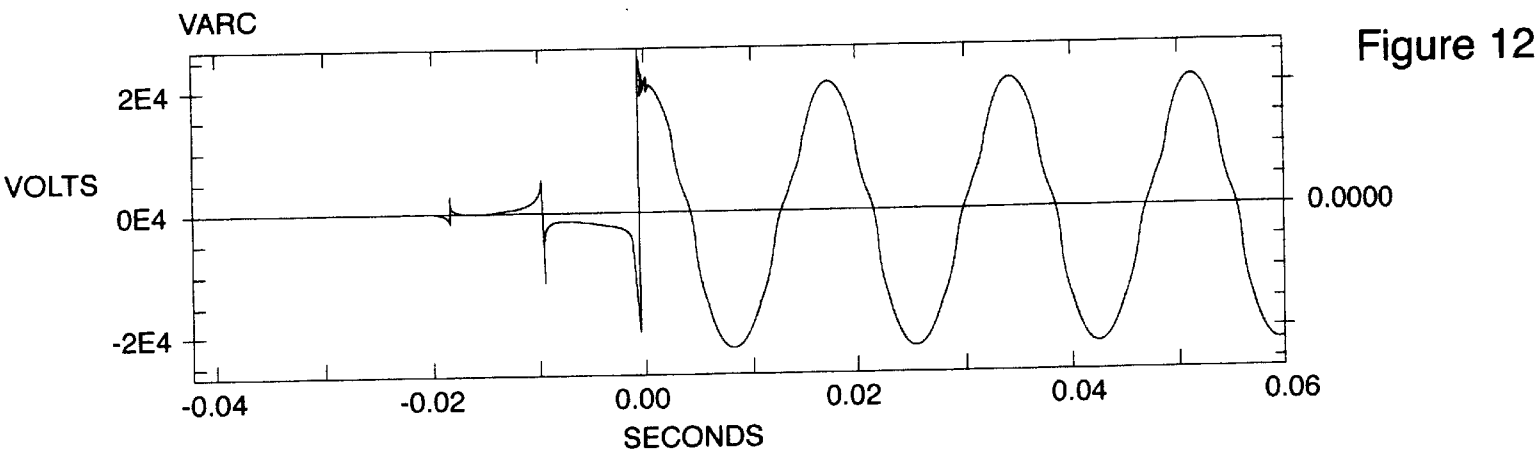
Figure 13:
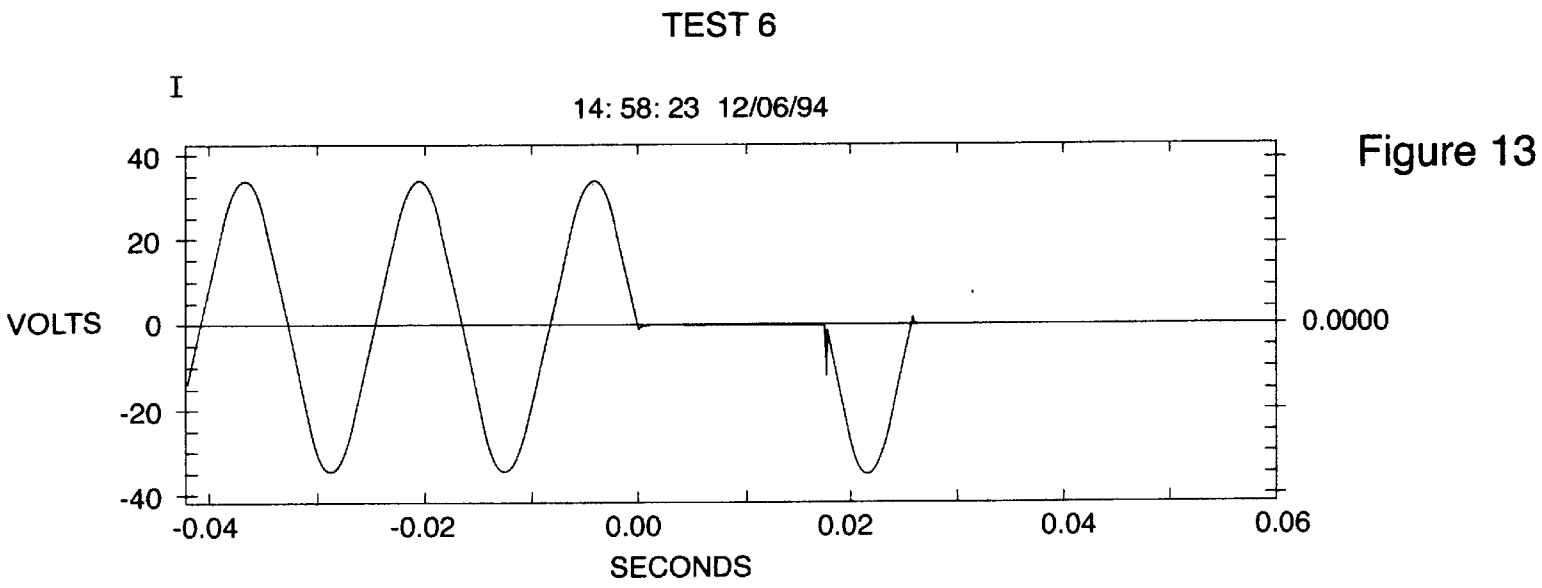
Figure 14:
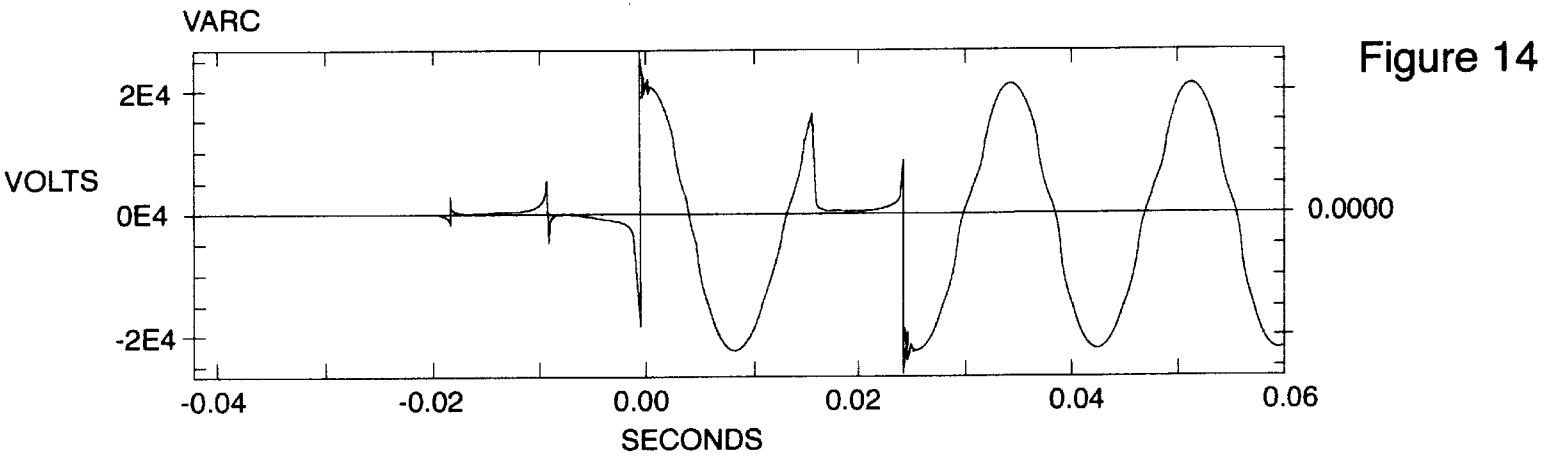
Figure 15:
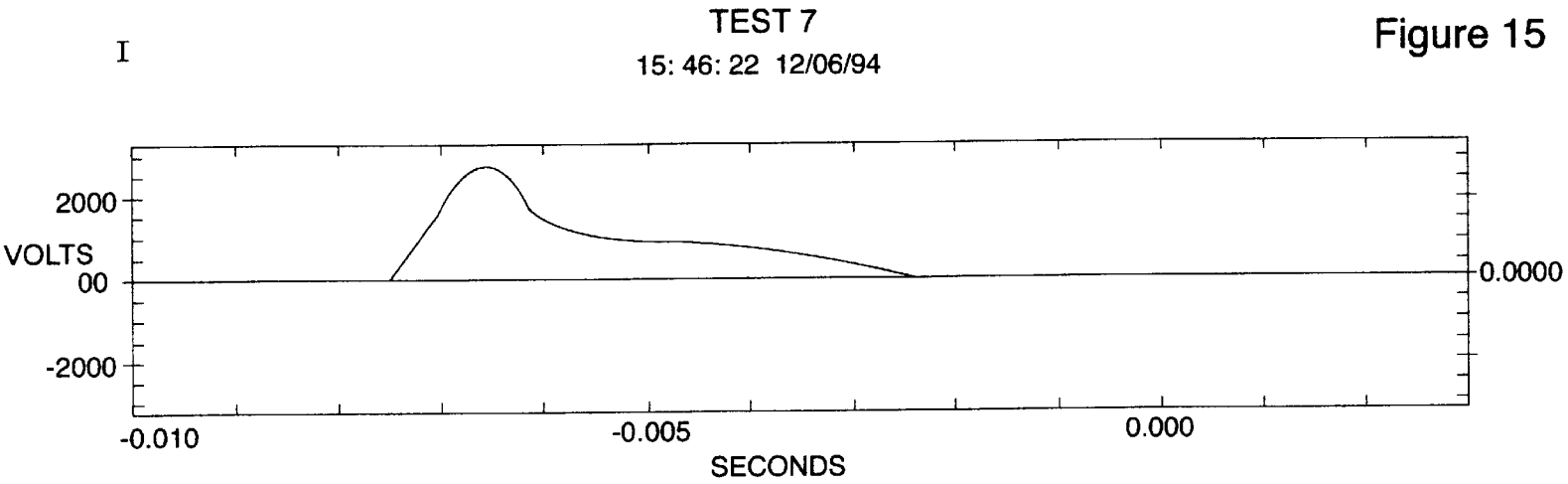

Referring now to FIGS. 2 and 3, the housing of high current fuse component 22 is formed by first compartment 24 of tube 18 closed at its opposite ends by end cap 36 and barrier 28. Inside the housing is provided a high current fuse element 48 comprising a metal ribbon supported on an internal support 50, both of which are separated from the inside wall of tube 18 by an energy absorbing filler 52, preferably sand. High current fuse element 48 is made of an electrically conductive material which melts at relatively low temperature, preferably silver, while support 50 is made of a non-conducting material such as mica. In fuse 14 having the above dimensions, the high current fuse element 48 is preferably comprised of a silver ribbon having spaced holes 53, and has a length of about 92 cm, a width of about 4.75 mm and a thickness of about 0.13 mm. The internal mica support 50 is preferably formed with square notches 54 in a manner known in the art. High current fuse element 48 is wound around notched support 50 at regularly spaced intervals of about 24 mm between the centers of adjacent coils, and is in electrical contact with the end cap 36, for example by being soldered thereto as at point 56.

The high current fuse component 22 of the present invention serves to interrupt high magnitude faults. This is accomplished by melting of high current fuse element 48. Upon melting at all of the notched locations of fuse element 48, high current fuse component 22 develops an arcing voltage that opposes and overcomes the system voltage and forces the current to zero. The first compartment 24 containing the high current fuse component 22 can also incorporate an indicator button (not shown) to indicate the status of high current fuse component 22.

The non-conductive barrier 28 separating compartments 24 and 26 is provided with a centrally located aperture 58 through which a conductive connector 60 passes. A first end 62 of connector 60 is in electrical contact with high current fuse element 48, while a second, threaded end 64 of connector 60 projects into second compartment 26. Connector 60 is secured to barrier 28 by a nut 66 threaded onto the second end 64 of connector 60, and the aperture 58 and edges of barrier 28 are sealed by a layer of hardened resin 68, such as an epoxy resin.

As shown in FIG. 3, low current fuse component 20 is contained in a small cylindrical housing 70 which is preferably made from fiber-glass. Housing 70 comprises a tube 72 sealed at its ends by end walls 74 and 76. Tube 72 has a length and diameter which allow it to fit inside second compartment 26 of fuse 14. The inner surfaces of the respective end walls 74, 76 are preferably provided with recessed edges 78, 80 such that the end walls 74, 76 project slightly into the ends of tube 72 and completely cover the ends thereof. Where fuse 14 has the above dimensions, tube 72 preferably has an outside diameter of about 48 mm, an inside diameter of about 44 mm and a length of about 77 mm. End walls 74 and 76 preferably have a diameter of 48 mm, a thickness of about 10 mm, with the edges 78 and 80 being recessed by about 5 mm.

Low current fuse component 20 comprises an electrically conductive low current fuse element 82 wound around a support 84, both of which are separated from the inner surfaces of housing 70 by energy absorbing filler 86, preferably sand. Low current fuse element 82 preferably comprises a thin conductive wire and is enclosed in an insulating casing 90 such as silicon rubber. Support 84 is preferably comprised of mica and has square notches 92, similar to mica support 50 described above. Where housing 70 has the above-described dimensions, the low current fuse element 82 preferably comprises a tin wire of diameter 1.25 mm and length 170 mm.

End wall 76 of housing 70 is provided with a centrally located aperture 94 through which projects an electrically conductive connector 96. Connector 96 has an enlarged head 98 which is located inside housing 70 and is in engagement with the inner surface of end wall 76. A shank 100 projects from the head 98 of connector 96, extends completely through end wall 76, and protrudes slightly therefrom. Connector 96 is provided with a threaded bore 102 extending through the center of the shank 100 and into the head 98. Threaded bore 102 is adapted to receive the second end 64 of connector 60 projecting into second compartment 26 of tube 18.

Embedded in the opposite end wall 74 of housing 70 is the head 104 of an electrically conductive connector 106. A threaded shank 108 of connector 106 projects outwardly from the end wall 74 and is adapted to be threaded into a nut 110 which is rigidly secured to the outer surface of the end wall 38 of end cap 34. The low current fuse element 82 is in electrical contact with connectors 96 and 106, thereby permitting electrical current to flow through low current fuse component 20 from one end of housing 70 to the other.

The fuse 14 is assembled by inserting low current fuse component 20 into second compartment 26 and threading the second end 64 of connector 60 into the bore 102 of connector 96, until a firm connection is achieved. End cap 34 is then secured over the end 30 of tube 18 by threading connector 106 into nut 110 until seal 46 tightly engages the end 30 of tube 18, thereby ensuring that fuse component 20 is sealed within compartment 26. When the fuse 14 is fully assembled, a continuous electrically conductive path is provided from end cap 34 to cap 36 via high current fuse element 48 and low current fuse element 82.

A conventional charge operated blown fuse indicator can also be housed within housing 70 inside end wall 74 to visually indicate when the low current fuse component 20 has been operated. The indicator comprises a small gunpowder charge which, when activated, fires a pin through the end wall 74 of housing 70. Where an indicator is used, a portion of the end wall 74 of housing 70 and the end wall 38 of end cap 34 may preferably be of reduced thickness to permit penetration by the pin. In another preferred embodiment, the indicator device doubles as a striker pin to activate the drop-out feature of the cutout.

The purpose of low-current component 20 of the non-venting cutout fuse 14 according to the invention is to interrupt low current overloads. It does so by the melting of the low current fuse element 82. When fuse element 82 melts, arcing and gases are generated and pieces of molten tin are blown out of tight fitting silicon tube 90. However, since low current fuse component 20 is filled with sand, the fuse component 20 and fuse 14 are able to withstand rupture and thereby withstand line potential. Furthermore, since compartments 24 and 26 are separated by barrier 28, and low current fuse component 20 is sealed within housing 70, operation of low current fuse component 20 does not damage high current fuse component 22, allowing high current fuse component 22 to be re-used.

After the fuse 14 operates to interrupt a current, it is removed and checked to determine which fuse component has operated. If only low current fuse component 20 is blown, then this component can be replaced and the fuse re-installed. If high current fuse component 22 has also blown, the entire fuse 14 must be replaced.

EXAMPLES

To further illustrate the function and the effectiveness of the invention, a series of tests were conducted with the fuse 14 having the construction and dimensions described above. The tests were designed to demonstrate how the replaceable low current fuse component could withstand, without failure, the large amounts of energy that it is forced to dissipate. The tests were also performed to verify the predicted time-current characteristics of the invention.

The invention was tested basically with two different circuits at the Ontario Hydro's High current laboratory. The circuits were chosen as the ones that were expected to be representative of two of the most onerous fault current conditions that the fuse would experience in the field. Both circuits had a nominal 15.5 kV open circuit voltage. It should be noted that the test program does by no means, and is not intended to, represent a full series of standards tests according to ANSI C37.41 "Design Tests for High Voltage Fuses". This standard, particularly the parts pertaining to interruption tests, was however, used as a guideline for the testing procedures.

The first test circuit provided currents from 20 to 100 Arms with relatively low X/R values. This provided currents just above the long time minimum melting characteristic of the fuse and required the low current element of the fuse to interrupt after a long period of heating. The ability of the small low current element housing to withstand such heating was of interest. The second test circuit provided a high fault current and was used to verify that the high current fuse component module would indeed interrupt on high currents.

For testing, the low current fuse component was connected to the high current fuse component and enclosed in the tube as described above, and mounted in a cutout as illustrated in FIG. 1. The resistance of each component was measured before and after each test to verify which component had operated and whether the intact components had suffered any damage during the testing. After the fuse operation, the voltage was maintained on the open fuse for a period of 1 or 10 minutes to ascertain whether or not the open fuse could withstand the system voltage without reigniting.

Test Results

The specific test conditions and results are summarized in Table 1. The actual current and voltage waveforms from the tests are provided in FIGS. 4 to 16. In Table 1, the low-current elements are referred to as NVF-1, NVF-2 etc, and the high current module is referred to as NVF-2B. Tests 1 to 6 were performed at low currents (20 to 100 A). The results show that the low current fuse component of the present invention operated successfully during each test to interrupt the current and withstand the voltage after the fuse had operated. In these tests the high current use element was left intact and undamaged.

Test 7 is a high current (5.5 kA) interruption test in which the high current fuse component of the invention successfully interrupted the fault current and withstood the recovery and 1 minute withstand voltage.

Figure 17:
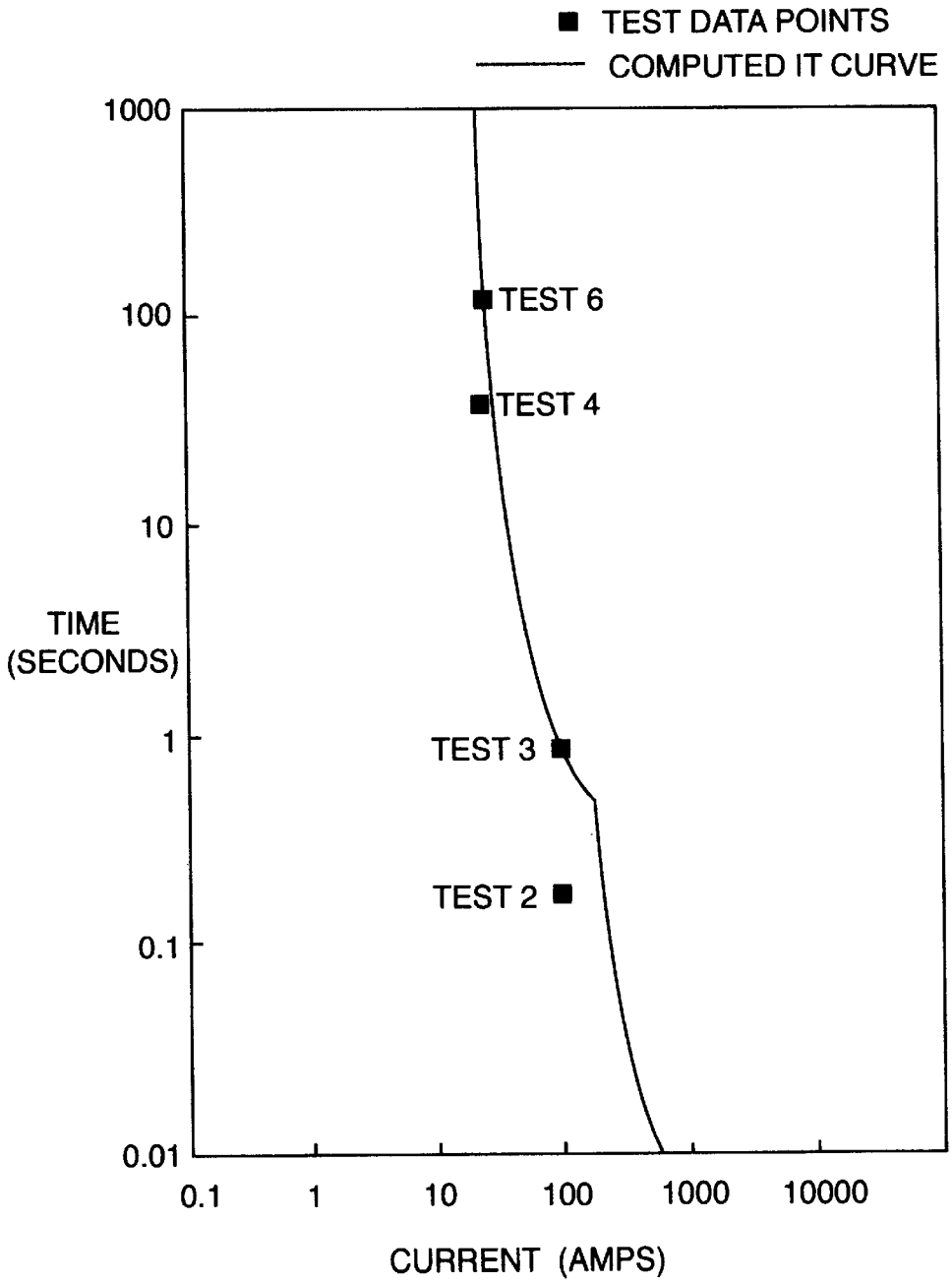
FIG. 17 is a current/time curve for the non-venting cutout mounted fuse according to the present invention.

The current/time curve in FIG. 17 shows the calculated current/time curve and the current and time coordinates at which the NVCF prototypes successfully interrupted. (Test 1 is not plotted since it was conducted on a slightly different initial prototype. The maximum interrupting current test at 5.5 kA and 0.75 ms is off the scale of this graph.) As shown in FIG. 17, there is a distinct break in the current/time curve at about 140 A. This is the point at which the high-current element takes over interruption from the low-current element. It is also to be noted that the calculated curve was an "average" melting curve. The measured current/time points on occasion fall below this calculated curve since there is an expected plus and minus tolerance to the calculated curve.

Figure 16:
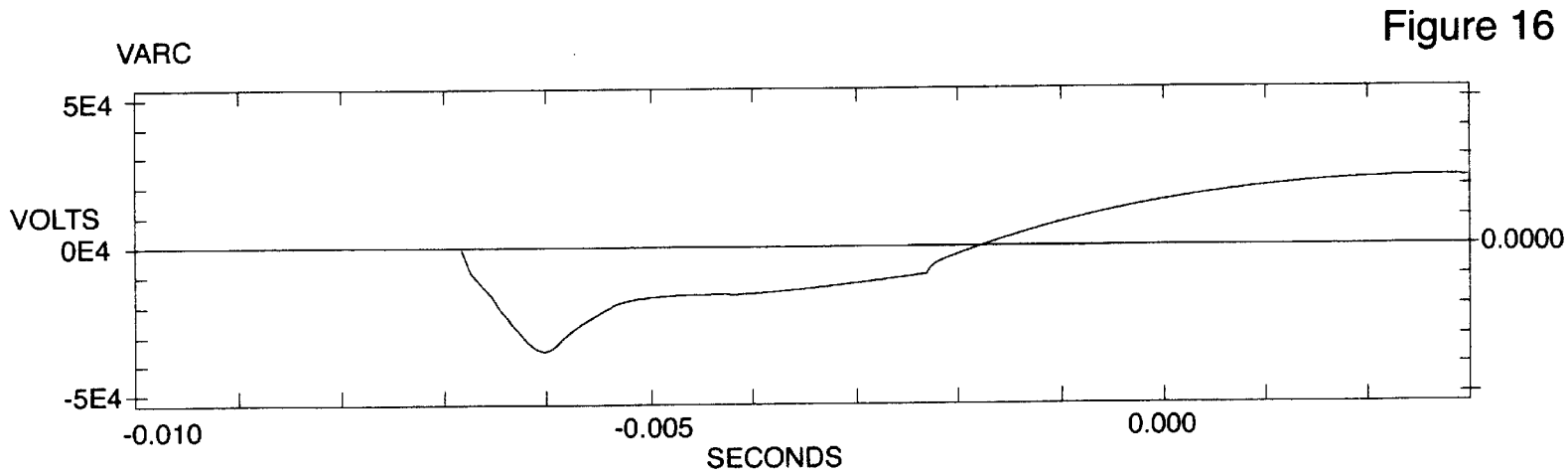

The test result prove the technical feasibility of the invention. Both the high and low current fuse components of the fuse successfully interrupted at the appropriate fault current levels. FIG. 16 also verifies that the calculations used in the design of the low current element were valid as a prediction of the average melting characteristic of that element.

The fuse is preferably designed to be installed as a direct replacement for distribution expulsion fuse links. The hardware required to mount the fuse in the cutout would be a one-time purchase. Once installed, the new fuse offers non-venting and current limiting overcurrent protection. When the fuse operates the cutout will drop out. The fuse should then be inspected to determine if the high or low current element has operated by looking at the fuse indicators. If the low current element has operated it is simply replaced and the whole fuse closed into the cutout. If the high current element has operated, there has been a major fault in the protected equipment. The equipment should be inspected, likely replaced and the entire fuse unit replaced and reclosed at the appropriate time.

As evident from the above, the present invention has several significant advantages over conventional fusing. It eliminates the hazard associated with the violent ejection of particles from expulsion fuses. It offers all of the advantages of the two-fuse system in a convenient single fuse unit. It is as compact as the present general-purpose CLF, however, the present invention is less expensive since it allows resetting of a low cost module after low current operations.

In contrast to distribution fuse links, the present invention does not allow any ejection of hot particles or gas when it operates and does not generate loud noise upon operation. This allows line staff to operate a cutout with confidence that they will not be subjected to expulsion by-products and explosive noises if the fuse is closed onto a fault.

The present invention offers all the advantages of the two fuse system with the expulsion and current limiting fuse as well as overcoming the disadvantages of this system. The present invention allows replacement of only the unit that has interrupted the overcurrent, thus saving the cost of replacing the intact fuse. The expulsion component is sized to blow on low currents. Only when the available fault current is high, does the more expensive current-limiting fuse operate. The present invention also allows the cutout to continue to act as a means of disconnecting the transformer. Beyond the capabilities of the two-fuse system, the present invention requires no more installation space than the cutout itself The present invention also eliminates the venting whereas at best it is only reduced by the two-fuse system.

It will be appreciated that the principles of the present invention may be applied to the production of non-venting cutout mounted fuses having a variety of ampere ratings by varying the characteristics of the high and low current fuse elements and/or other components of the fuse. It will also be appreciated that the preferred non-venting cutout mounted fuse described above has a relatively low ampere rating (roughly about 10 A), having a low current fuse element which operates at about 20 A to 100 A and a high current element which operates from above about 100 A up to about 50,000 A.

The invention having been so described, certain modifications and adaptions will be obvious to those skilled in the art. In particular, it is to be appreciated that the construction and dimensions of the preferred fuse described above can be varied without departing from the spirit and scope of the invention. The invention includes all such modifications and adaptions which follow in the scope of the appended claims.

TABLE 1

NON-VENTING FUSE TEST RESULTS

| Test No. | Fuse ID | Resist Low Element (mohm) | Resist High Element (mohm) | Prospect Current (A rms) | Test Volt (kV) | X/R | Close Angle | Time Melt (ms) | Time Arc (ms) | Time Total (ms) |
|---|---|---|---|---|---|---|---|---|---|---|
| 1 | NVF-1 | B: 4.8<br>A: Open | B: 29.7<br>A: 28.2 | 105 | 15.1 | <1 | Rand | ND | ND | 1.8 s<br>+<br>31 s<br>cool<br>+<br>7.6 s |
| 2 | NVF-2<br>&<br>NVF-2B | B: 25.8<br>A: Open | B: 47.4<br>A: 46.7 | | 16.8 | 2.21 | Rand | 155.7 | 18.7 | 174.4 |
| 3 | NVF-4<br>&<br>NVF-2B | B: 15.1<br>A: Open | B: 46.7<br>A: 46.7 | 83.8 | 15.9 | 2.21 | Rand | 684.5 | 14.5 | 899 |
| 4 | NVF-5<br>&<br>NVF-2B | B: 17.8<br>A: Open | B: 46.7<br>A: 47.7 | 23.4 | 15.9 | 3.16 | Rand | 40.3 s | 21 ms | 40.3 s |
| 5 | NVF-3<br>&<br>NVF-2B | B: 7.3<br>A: 7.3 | B: 47.7<br>A: 53.5<br>Hot | 23.2<br>24<br>35.2 | 15.9<br>15.9<br>15.9 | 3.15<br>3.2<br>2 | Rand<br>Rand<br>Rand | NA | NA | 15<br>min<br>15<br>min<br>3 min |
| 6 | NVF-6<br>&<br>NVF-2B | B: 16.7<br>A: Open | B: 53.5<br>A: 46.9 | 23.2 | 15.9 | 3.2 | Rand | 115 s | 19 +<br>16 clr<br>+ 6.6<br>= 44 | 115 s |
| 7 | NVF-3<br>&<br>NVF-2B | B: 7.2<br>A: 7.3 | B: 47.3<br>A: Open | 5.6kA | 15.6 | 8.3 | 1 init 54° after $V_n$<br>arc init 71° after $V_n$ | 0.75 | 4.5 | 6.25 |

| Test No. | $I^2t$ Melt ($kA^2s$) | $I^2t$ Arc (As) | $I^2t$ Total ($kA^2s$) | Energy Melt (J) | Energy Arc (kJ) | Energy Total (kJ) | $I_{Pk}$ (kA) | $V_{Pk}$ (kV) | Rec Volt Dur (min) |
|---|---|---|---|---|---|---|---|---|---|
| 1 | ND | ND | ND | ND | ND | ND | ND | ND | 10 min |
| 2 | 1.38 | 160 | 1.54 | 118 | 0.7 | 0.71 | .13 | 22 | 10 s +<br>30 s ols<br>+ 1 min |

TABLE 1-continued

NON-VENTING FUSE TEST RESULTS

| | | | | | | | | | |
|---|---|---|---|---|---|---|---|---|---|
| 3 | 8.08 | 134 | 6.2 | NA | 1.0 | NA | .13 | 22 | 1 min |
| 4 | NA | 11.3 | NA | NA | 0.35 | NA | .03 | 22 | 10 min |
| 5 | NA | NA | NA | NA | NA | NA | NA | NA | no melt<br>no melt<br>no melt |
| 6 | NA | 14.6 | NA | NA | 0.31 | NA | .03 | 23 | 10 min |
| 7 | 1.62 | 7.5 | 9.13 | 147 | 108 | 108 | 2.8 | 36.7 | 1 min |

What is claimed is:

1. A current limiting fuse for attachment to a cutout, comprising:

(a) a first housing having first and second compartments and a barrier separating said first and second compartments, said housing comprising a tube having first and second ends closed by first and second end cap members, respectively, the end cap members being made of an electrically conductive metal and making electrical contact with the cutout when the fuse is mounted thereto, (b) a first fuse element which operates at a high current, said first fuse element contained within the first compartment and being in electrical contact with the first end cap member, (c) a second fuse element which operates at low current, said second fuse element contained within the second compartment, being in electrical contact with the second end cap member, and being electrically connected in series to the first fuse element through said barrier, wherein the second fuse element is contained within a second housing which is slidably received within said second compartment and releasably connected to a first electrically conductive connecting means which extends through said barrier and electrically connects said first and second fuse elements, said second housing being sealed and the second fuse element contained therein being isolated from the second housing by an energy-absorbing filler, such that any discharge resulting from operation of the second fuse element is contained within the second compartment.

2. A current limiting fuse as defined in claim 1 wherein the second end cap member forms a removable cover over the second end of said tube.

3. A current limiting fuse as defined in claim 2 wherein the second end cap member is provided with a sealing member which is adapted to form a seal between the second end cap member and the second end of the tube to thereby seal the second compartment.

4. A current limiting fuse as defined in claim 3 wherein the second end cap member is releasably connected to the second fuse element through a second electrically conductive connector extending through said second housing.

5. A current limiting fuse as defined in claim 4 wherein the sealing member is positioned between the second end of the tube and the second end cap member, and wherein the second electrically conductive connector biases the second end cap toward the second housing.

6. A current limiting fuse for attachment to a cutout, comprising:

(a) a first housing having first and second compartments and a barrier separating said first and second compartments, said housing comprising a tube having first and second ends closed by first and second end cap members, respectively, the end cap members being made of an electrically conductive metal and making electrical contact with the cutout when the fuse is mounted thereto, (b) a first fuse element which operates at a high current, said first fuse element contained within the first compartment and being in electrical contact with the first end cap member, (c) a second fuse element which operates at low current, said second fuse element being contained within the second compartment, being in electrical contact with the second end cap member, and being electrically connected in series to the first fuse element through said barrier, the second fuse element having first and second ends being contained in a second housing which is received inside the second compartment of the tube between the barrier and the second end cap member, wherein the second end cap member is removable from the second end of the tube to permit removal of the second housing therefrom, the first end of the second housing being releasably connected to a first electrically conductive connecting means which extends through said barrier to electrically connect said first and second fuse elements, and the second end of the second housing being releasably connected to the second end cap member.

7. A current limiting fuse as defined in claim 6, wherein the second housing is sealed and the second fuse element contained therein is isolated from the second housing by an energy-absorbing filler, such that any discharge resulting from operation of the second fuse element is contained within the second compartment.

8. A current limiting fuse as defined in claim 6, wherein the first electrically conductive connecting means extending through the barrier is threaded and threadingly engages a threaded electrically conductive connector in the first end of the second housing which is in electrical contact with the second fuse element.

9. A current limiting fuse as defined in claim 6, wherein the second end cap member is releasably connected to the second fuse element through a second electrically conductive connector extending through the second end of the second housing.

10. A current limiting fuse as defined in claim 9, wherein the second electrically conductive connector has a threaded shank which is threaded into a nut which is rigidly secured to an end wall of the end cap member.

11. A current limiting fuse as defined in claim 6, wherein the second end cap member is provided with a sealing member which is adapted to form a seal between the second end cap member and the second end of the tube to thereby seal the second compartment.

* * * * *

UNITED STATES PATENT AND TRADEMARK OFFICE

CERTIFICATE OF CORRECTION

PATENT NO. : 6,211,768 B1
DATED : April 3, 2001
INVENTOR(S) : Stephen L. Cress; Robert J. Tout It is certified that error appears in the above-identified patent and that said Letters Patent is hereby corrected as shown below:

Title page,
Item [73], the following should be added to the assignee data:

-- Municipal Electric Association, Toronto (CA) --

Signed and Sealed this

Second Day of April, 2002

*Attest:*

*Attesting Officer*

JAMES E. ROGAN
*Director of the United States Patent and Trademark Office*